US008002598B2

(12) United States Patent
Ninham et al.

(10) Patent No.: US 8,002,598 B2
(45) Date of Patent: Aug. 23, 2011

(54) ADJUSTABLE ROWLOCK

(76) Inventors: Paul John Ninham, South Murwillumbah (AU); Lindsay Gamble, Tallong (AU)

( * ) Notice: Subject to any disclaimer, the term of this patent is extended or adjusted under 35 U.S.C. 154(b) by 337 days.

(21) Appl. No.: 12/363,508

(22) Filed: Jan. 30, 2009

(65) Prior Publication Data

US 2010/0035490 A1 Feb. 11, 2010

(51) Int. Cl.
*B63H 16/00* (2006.01)

(52) U.S. Cl. ..... 440/107

(58) Field of Classification Search ..... 440/104–108
See application file for complete search history.

(56) References Cited

U.S. PATENT DOCUMENTS

| | | | | | |
|---|---|---|---|---|---|
| 742,490 | A * | 10/1903 | Pray | 440/107 |
| 813,762 | A * | 2/1906 | Anderson | 440/107 |
| 3,094,821 | A * | 6/1963 | Eckert | 451/387 |
| 3,531,865 | A * | 10/1970 | Nelson | 33/26 |
| 3,898,950 | A | 8/1975 | Martin | |
| 4,516,941 | A | 5/1985 | Reid | |
| 4,889,509 | A | 12/1989 | Pohlus | |
| 5,324,218 | A | 6/1994 | Rijnders | |
| 5,474,008 | A | 12/1995 | Vespoli et al. | |
| 6,183,325 | B1 * | 2/2001 | Purser | 440/106 |
| 7,670,201 | B2 * | 3/2010 | Winter | 440/109 |

* cited by examiner

*Primary Examiner* — Stephen Avila
(74) *Attorney, Agent, or Firm* — Janet Sleath; Speckman Law Group PLLC

(57) ABSTRACT

An adjustable rowlock for changing the orientation of the blade of an oar has a body with a clamp and clamp adjusting means. There is also an oar sleeve having a datum mark to be aligned with a plurality of reference marks arranged on the body. In use, a user may choose from a plurality of orientations of the blade corresponding to the reference marks, to suit the water conditions.

9 Claims, 11 Drawing Sheets

ADJUSTABLE ROWLOCK

TECHNICAL FIELD

The present invention relates to rowlocks for use with rowing shells, and more particularly to a manually adjustable rowlock which permits the orientation of the blade of the oar to be changed by a rower to suit water conditions while the shell is in the water.

BACKGROUND ART

Rowing shells, consisting primarily of rowing boats and sculling boats, are moved through the water by oars. The oars transmit the power of the rower to the water, drawing on strength and proper motions primarily from legs, arms, and back. The speed of the shell is determined by strength, technique, and the efficiency of the transmission of the rower's power through the oar to the water.

Among other things, the transmission of the rower's power is dependent on the relationship of the oar to the surface of the water. The vertical angle of the rowlock, which controls the orientation of the blade of the oar, is important and dependent on water and wind conditions.

Various means have been suggested for improving the adjustability of rowlocks so as to increase the efficiency of the operation of boats that are powered by rowers. See, generally, U.S. Pat. Nos. 3,898,950; 4,516,941; 4,889,509; 5,324,218; and 5,474,008.

These patents do not, however, disclose the use of rowlocks which may be readily adjusted in the water so as to accommodate the variations in water conditions.

The design and construction of most known rigging is such that adjusting the angle of the rowlock requires a relatively complex sequence of adjustments.

Sections of the rowlock must be partially or fully disassembled, then reassembled to make an adjustment to the angle of the rowlock. These adjustments usually require simple hand tools.

Frequently, adjusting the angle of the rowlock is a trial and error process until the right pitch is found for the water conditions.

Because of the difficulty in making such adjustments, they are normally made on land prior to placing the rowing shell in the water, or they are not made at all because it is not practical to make such adjustments each time water conditions change.

There remains, therefore, a need for an effective means for manually adjusting rowlock angle while a rowing shell is in the water in order to provide for efficient use of the power generated by the rower.

DISCLOSURE OF INVENTION

It is an object of the present invention to provide a manually adjustable rowlock which permits the orientation of the blade of the oar to be changed by a rower to suit water conditions while the rowing shell is in the water.

It is a further object of the present invention to provide such a rowlock which is adapted for use with conventional rigging without requiring meaningful modification of the rigging.

It is another object of the present invention to provide a manually adjustable rowlock which makes it possible for rowers to adjust the blade orientation without requiring the use of tools.

According to the present invention there is provided an adjustable rowlock for changing the orientation of the blade of an oar, the rowlock comprising a body having a clamp and clamp adjusting means, and an oar sleeve having a datum mark to be aligned with a plurality of reference marks arranged on the body so that a user may choose from a plurality of orientations of the blade corresponding to the reference marks, to suit the water conditions.

Preferably the clamp includes upper and lower sections which are pivotally connected at a first end and releasably connected at a second end.

It is preferred that the rowlock includes a rotating bracket which is positioned within the upper and lower sections of the clamp.

In a preferred embodiment, the rotating bracket has the reference marks arranged thereon.

It is also preferred that the rotating bracket has one or more datum surfaces whose orientation relative to the clamp is adjustable using the clamp adjusting means.

Preferably, the range of motion of the or each datum surface on the rotating bracket is restricted by one or more locking stops on the body of the rowlock.

More preferably, the rotating bracket has ridges to secure the lateral position of the rotating bracket within the upper and lower sections of the clamp.

It is preferred that the rowlock further comprises a clip which is affixed to the rotating bracket and rotates adjacent to the clamp.

In a preferred embodiment, a bush is placed between the rotating bracket and the clamp to reduce friction when feathering the oar.

It is also preferred that the body includes a spindle which is adapted to permit a vertical range of movement of the oar.

Preferably, the body also includes a rowlock pin housing adapted to connect to the spindle.

More preferably, the rowlock pin housing is adapted to permit a horizontal range of movement of the oar.

MODES FOR CARRYING OUT THE INVENTION

As employed herein, the term "rowing shells" means sweep boats, sculls, canoes and other rowing boats, for which it would be convenient to adjust the angle of the rowlock regardless of what means are employed to attach it to the boat.

Figure 1:
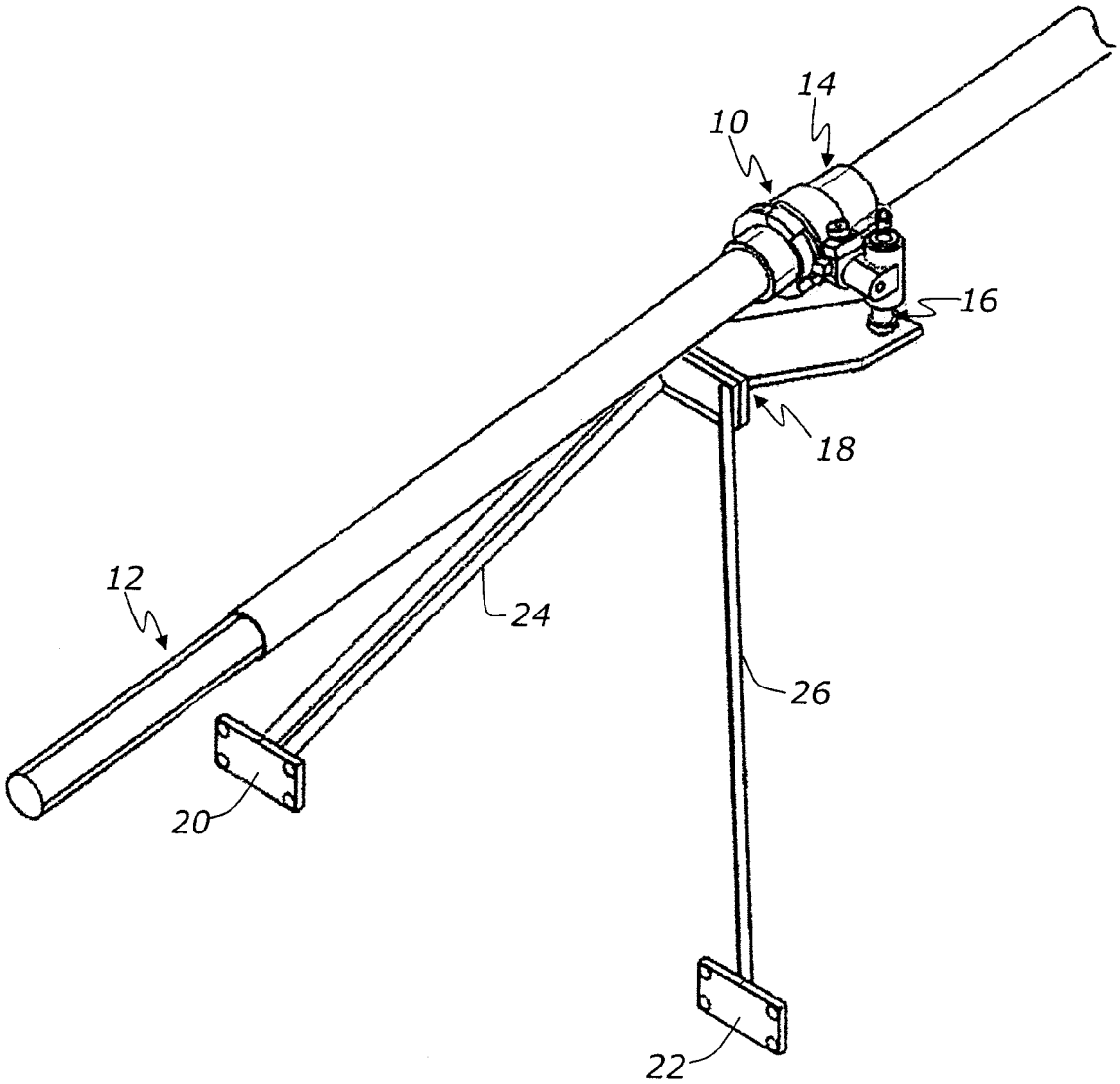
FIG. 1 is a perspective view of a rowlock according to a preferred embodiment of the present invention, in use.

As shown in FIG. 1, the rowlock 10 supports the oar 12 via sleeve 14. The rowlock 10 pivots on a rowlock pin 16 which allows the oar 12 to rotate about the longitudinal axis of the rowlock pin 16, and thereby sweep through an arc which lies in an essentially horizontal plane.

The rowlock pin 16 is supported by a rigger 18 having struts 18 and 20 which are attached by mounts 22 and 24 to the gunwale of a shell (which is not shown).

Figure 2:
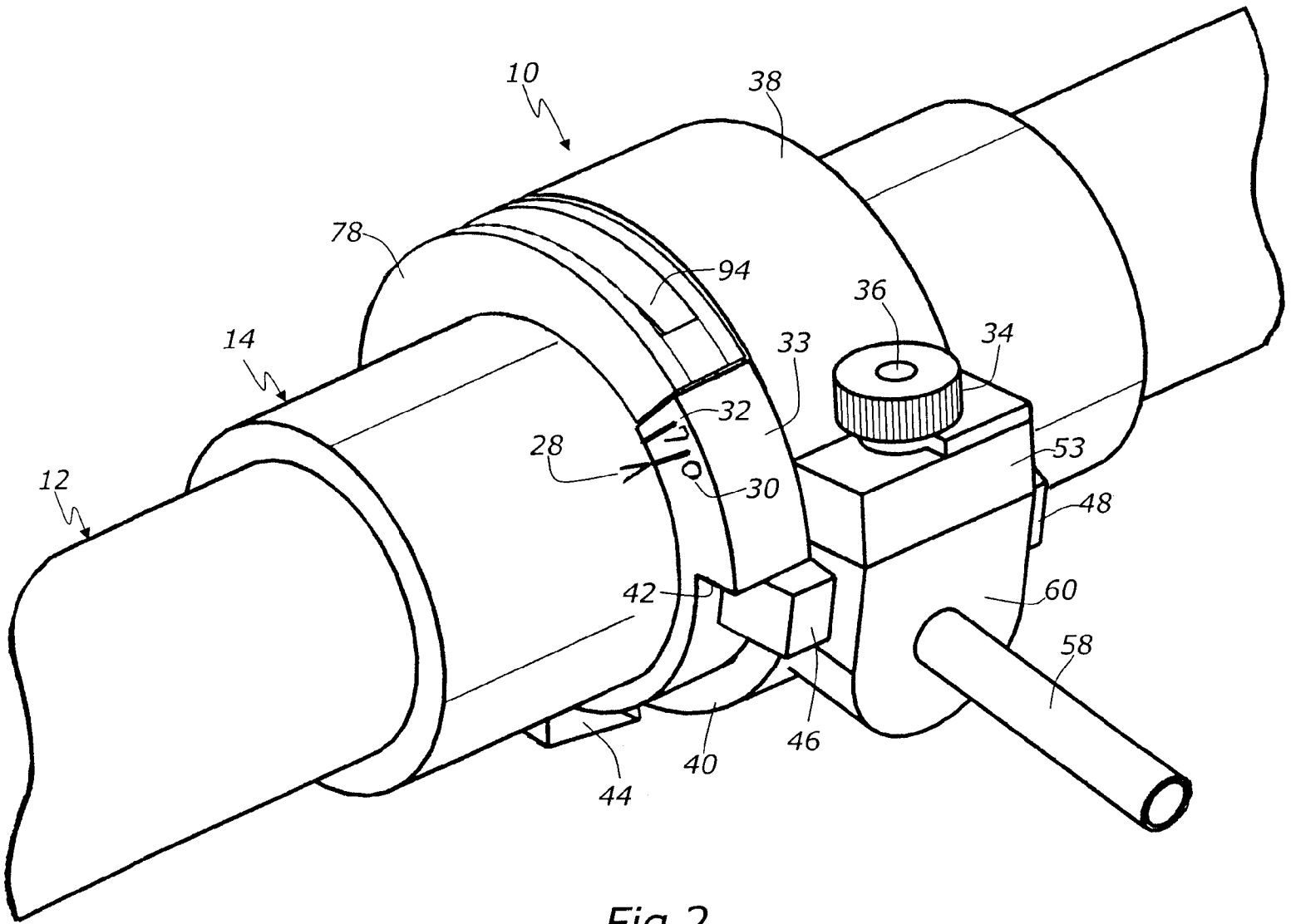
FIG. 2 is a close-up view of the rowlock of FIG. 1.

A close-up view of the rowlock 10 is shown in FIG. 2. The sleeve 14 features a datum mark 28 for aligning with one or more reference marks, such as lines 30 and 32 on the rotating bracket 33.

In use, a rower unscrews the nut 34 from the threaded shaft 36, which loosens the upper section 38 of the rowlock 10 from its lower section 40, and thereby allows the rower to rotate the datum mark 28 on the sleeve 14 to the reference mark 30 or 32 to suit the water conditions. When the desired oar blade angle is achieved, the nut 34 is re-tightened.

Figure 4:
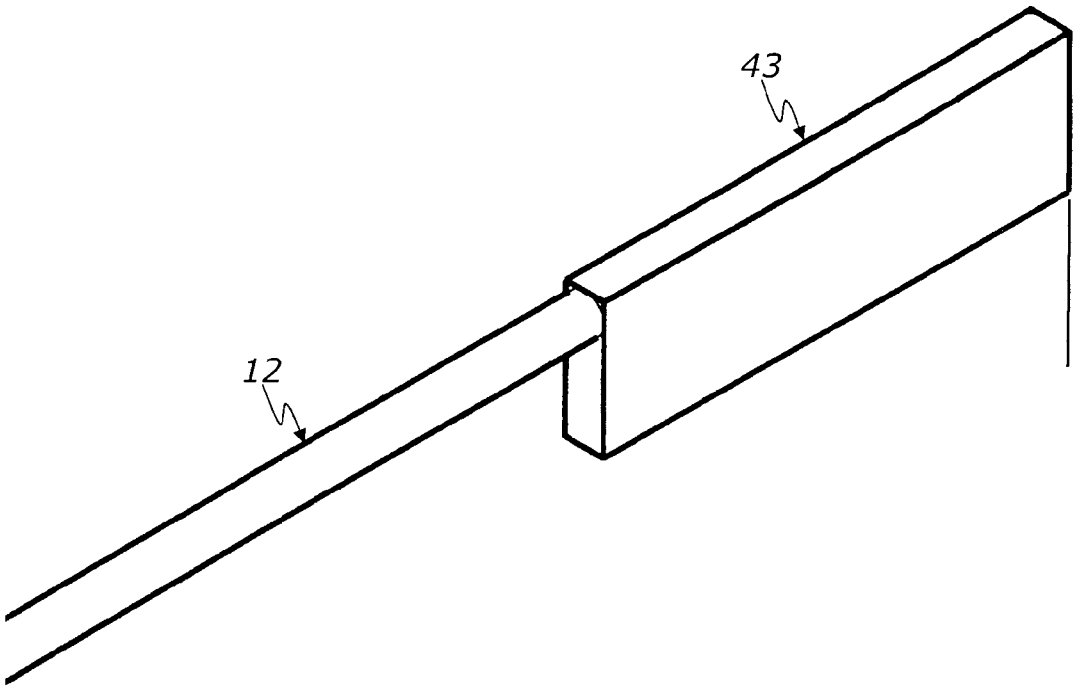
FIG. 4 is a perspective view of the blade of an oar at a first position, for use with the rowlock of FIG. 1.

For example, when the datum mark 28 on the sleeve 14 is aligned with the reference mark 30, the blade 43 of the oar 12 is oriented at 00 from the vertical (as shown in FIG. 4). This orientation of the blade 43 suits flat water conditions because the blade 43 effectively cuts through a perpendicular water surface.

Figure 5:
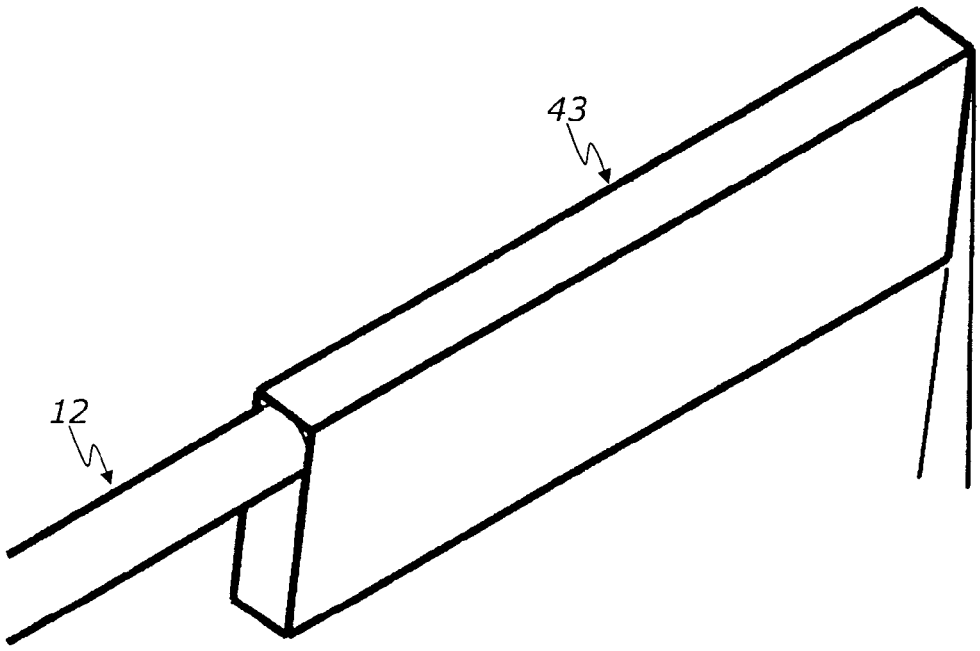
FIG. 5 is a perspective view of the blade of an oar at a second position, for use with the rowlock of FIG. 1.

When the datum mark 28 on the sleeve 14 is aligned with the reference mark 30, the blade 43 of the oar 12 is oriented at 70 from the vertical (as shown in FIG. 5) which suits rough or choppy water conditions. The blade 43 is able to cut through and enter a wave more effectively when presented to the surface of the wave at an oblique angle.

During a stroke, the rower can feather the oar 12 along its longitudinal axis between the datum surfaces 42 and 44. For instance, when the oar 12 is out of the water, the datum surface 44 abuts against the locking stop 46, and when oar 12 is in the water, the datum surface 42 abuts against the locking stop 42.

Figure 6:
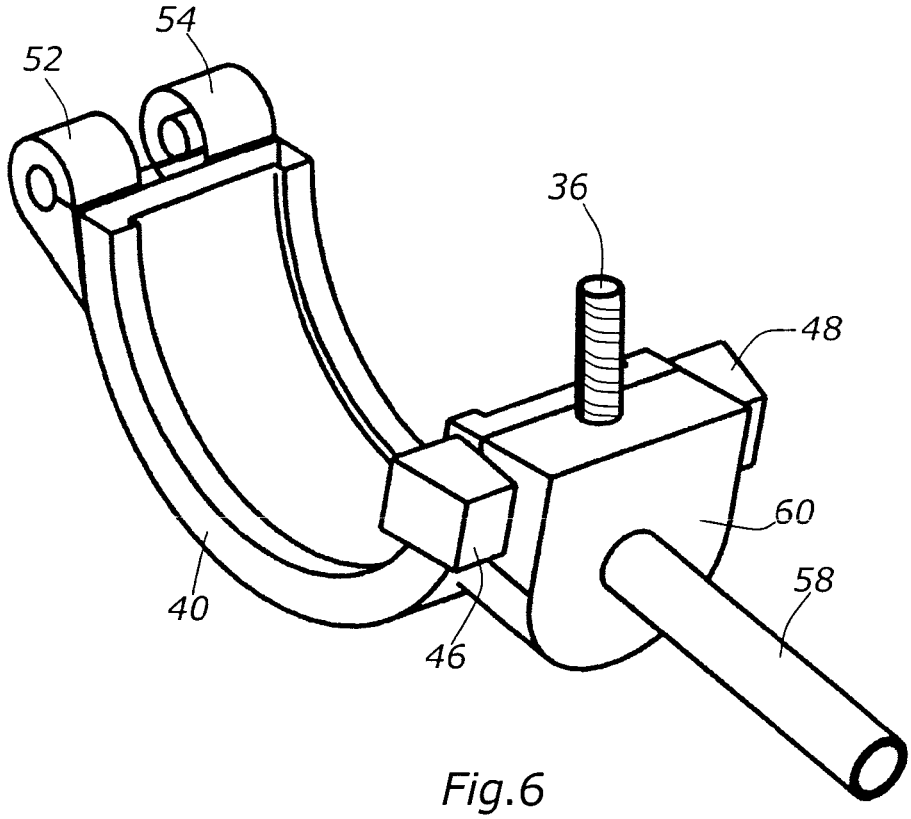
FIG. 6 is a perspective view of the lower section of the rowlock of FIG. 1.
Figure 7:
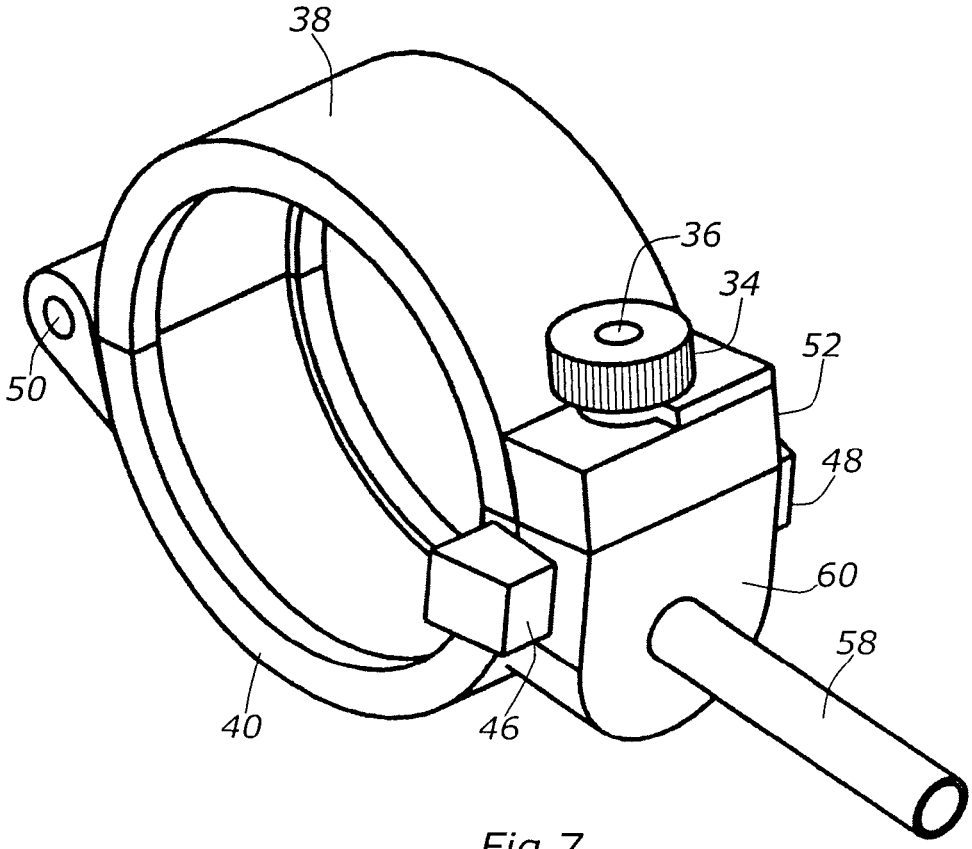
FIG. 7 is a perspective view of the lower section shown in FIG. 6 connected with an upper section.

The rowlock 10 comprises a lower section 40 shown in FIG. 6. The lower section 40 has two locking stops 46 and 48. The locking stop 46 is adapted for a positive fulcrum, and the locking stop 48 is adapted for a negative fulcrum.

Figure 3:
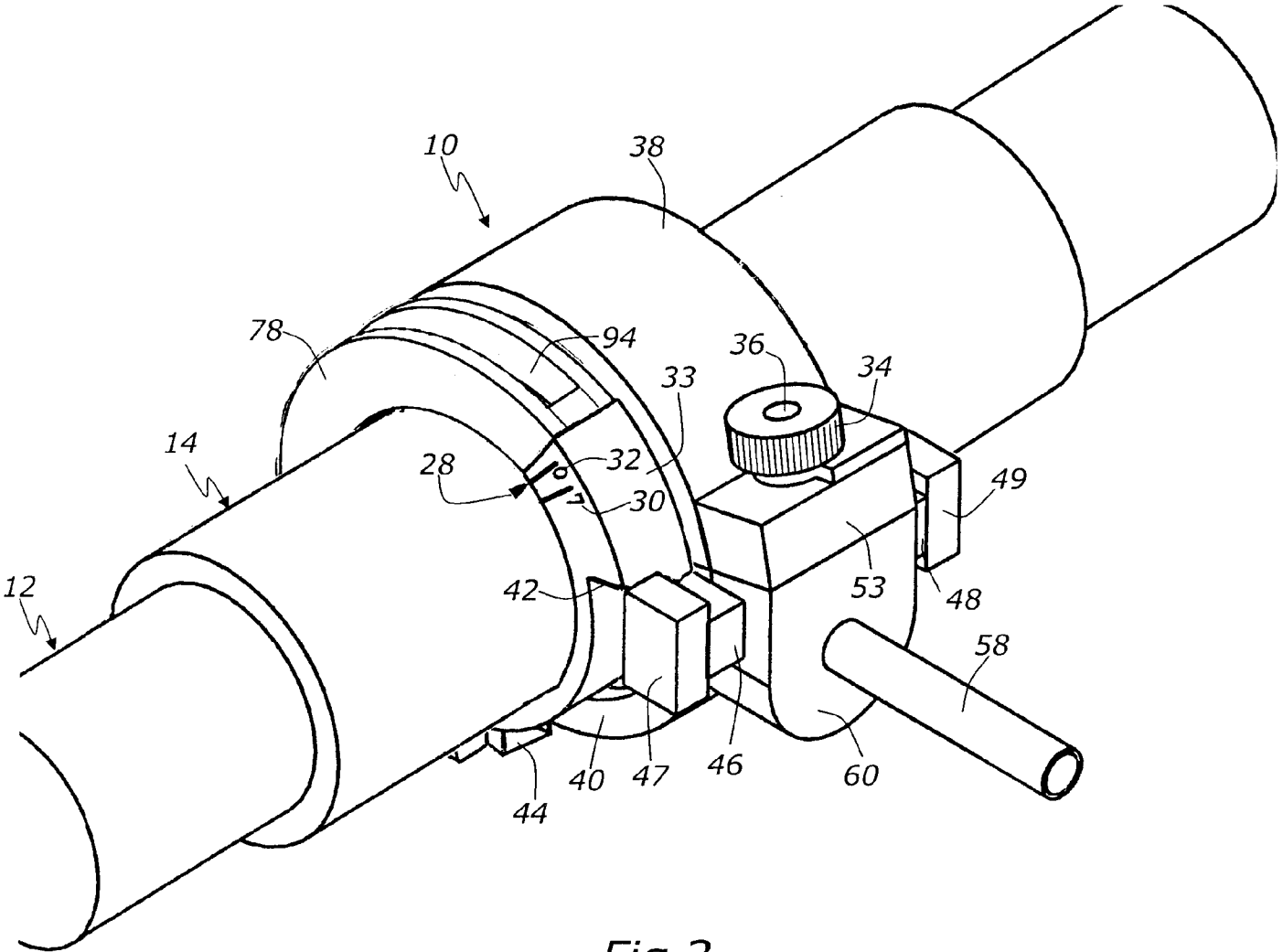
FIG. 3 is a close-up view of the rowlock of FIG. 2, including locking catches.

An alternative set of locking stops are shown in FIG. 3. In this embodiment of the present invention, the locking stops 46 and 48 have attached thereto a set of locking catches 47 and 49 respectively. The locking catches interface with recesses in the rotating bracket 33, and assist in preventing the movement of the rotating bracket 33 within the releasable clamp formed by the lower section 40 and the upper section 38.

It is preferred that the blade 43 is positioned asymmetrically with respect to the oar 12 (as shown in FIGS. 4 and 5).

The upper section 38 is pivotally joined at a first end to the lower section 40 by means of inserting pin 50 through hinge members 52 and 54 on the lower section 40 and hinge member 54 (not shown) on the upper section 38.

The upper section 38 is releasably clamped at a second end to the lower section 40 by means of inserting the threaded shaft 36 into a hole in the flat end 53 of the upper section 38, and securing the upper section 38 by threading the nut 34 along the shaft 36.

Figure 8:
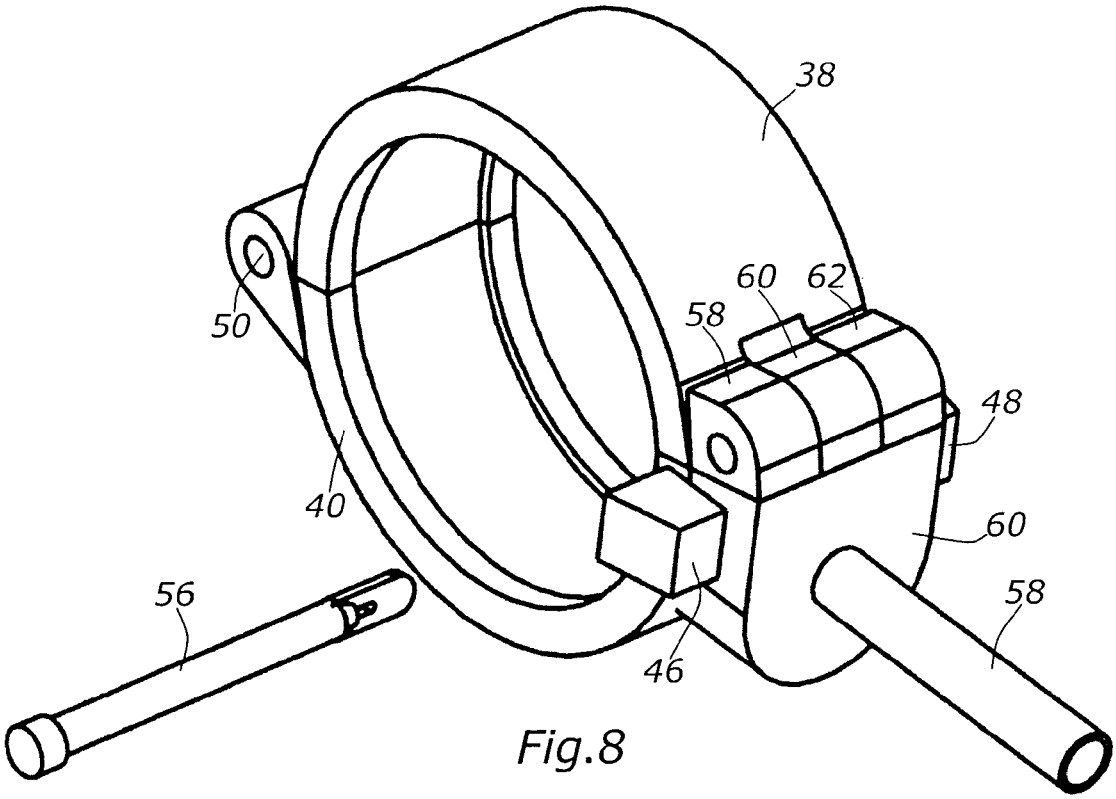
FIG. 8 is a perspective view of an alternate means of connecting the upper and lower sections of the rowlock shown in FIG. 7.
Figure 9:
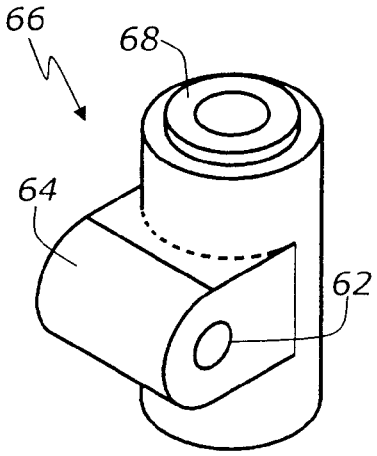
FIG. 9 is a perspective view of a pin housing of the rowlock of FIG. 1.
Figure 10:
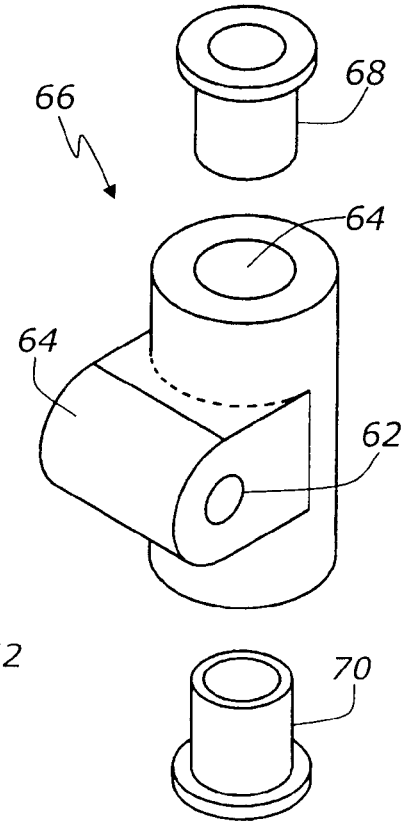
FIG. 10 is an exploded view of the pin housing of FIG. 9.

A second means of clamping the upper section 38 to the lower section 40 is shown in FIG. 8. A pin 56 is inserted through joining members 58 and 62 on the lower section 40 and an aperture within joining member 60 on the upper section 38.

There are many other means of clamping the upper section 38 to the lower section 80, including a release handle. The various means of securing the clamp are considered to come within the scope of the present invention.

A spindle 58 is attached to the body 60 of the lower section 40. The spindle 58 is inserted through the aperture 62 on flange 64 of the pin housing 66. The spindle 58 permits a vertical range of movement of the oar 12.

Figure 11:
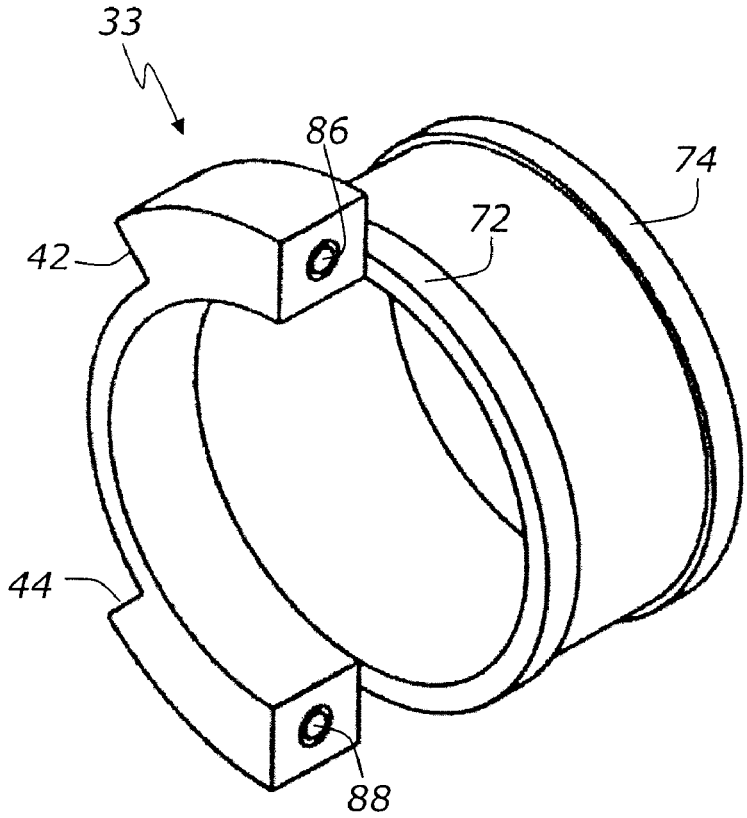
FIG. 11 is a perspective view of a rotating bracket of the rowlock of FIG. 1.
Figure 14:
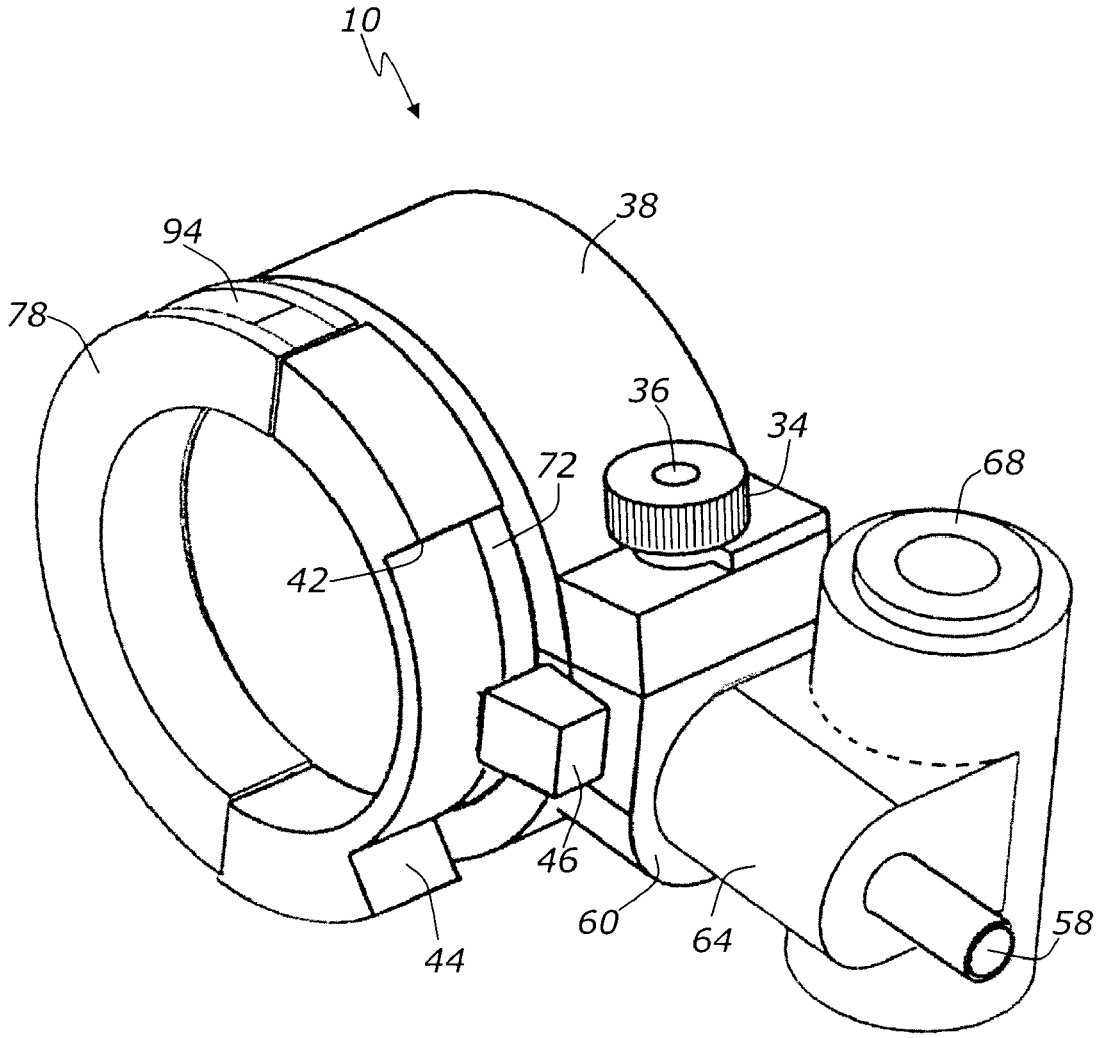
FIG. 14 is a perspective view of a fully assembled rowlock according to a first embodiment of the present invention.

The rowlock pin 16 (shown in FIG. 1) is inserted through aperture 64 in the pin housing 66 (see FIG. 14). The rowlock 10 rotates in a horizontal plane about the pin 16 with the assistance of bushes 68 and 70 in the housing 66. The rotating bracket 33 is shown in FIG. 11, which, in use, is laterally secured in position between the upper section 38 and the lower section 40 of the rowlock 10 by means of rims 72 and 74 (see FIG. 14)

Figure 12:
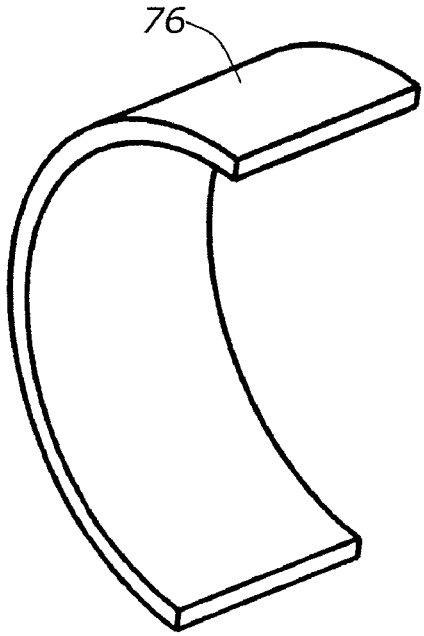
FIG. 12 is a perspective view of a bush which is adapted to be used between the rotating bracket of FIG. 11 and the connected upper and lower sections of FIG. 7.

A bush 76, shown in partial section in FIG. 12, reduces friction between the upper section 38 and the lower section 40 and the rotating bracket 33 whilst the rower is feathering the blade 43.

Figure 13:
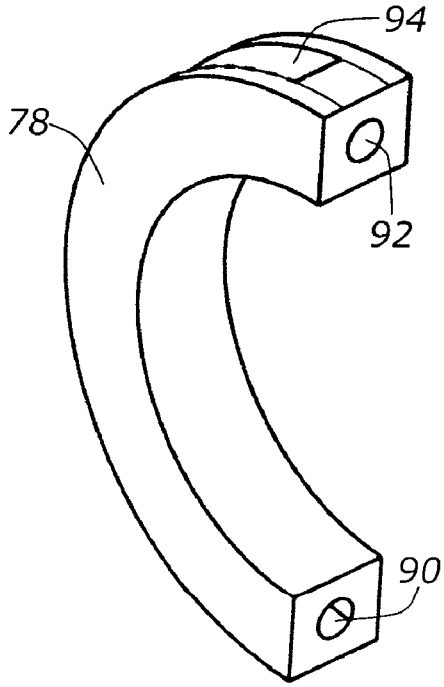
FIG. 13 is a perspective view of a clip which is adapted to be connected to the rotating bracket of FIG. 11.

A clip 78, shown in FIG. 13, is affixed to the rotating bracket 33, by means of a screw (not shown) which is fed through the access provided by the recess 94 and through the bore 92 in the clip 78, and then into the bore 86 on the rotating bracket 33. The clip 78 may provide a surface for the marking of additional reference marks for positioning the blade 43 of the oar 12.

Figure 15:
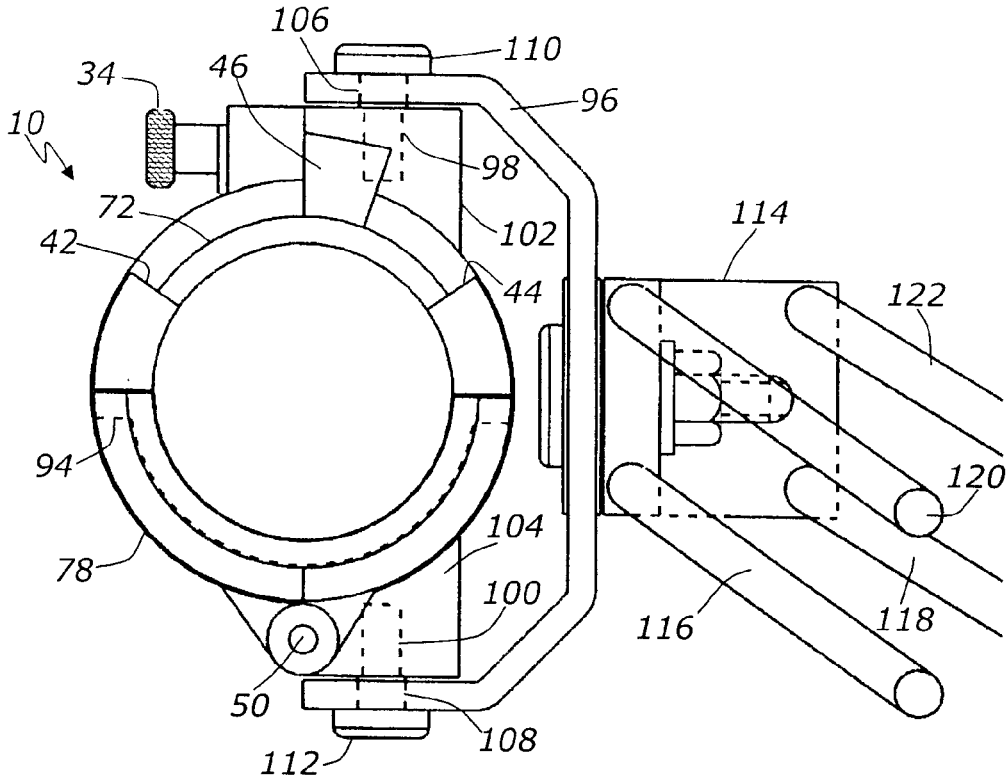
FIG. 15 is a perspective view of a fully assembled rowlock according to a first embodiment of the present invention.

Another embodiment of the present invention is shown in FIG. 15 (in which like parts are given like numbers to previous figures). The rowlock 10 is positioned with respect to the frame 96 so that holes 98 and 100 within the members 102 and 104 align with holes 106 and 108 in the frame 96. Bushes 110 and 112 are then inserted into the holes 106 and 108, and a screw (which is not shown) fixes the alignment of the members 102 and 104 with respect to the bushes 110 and 112.

Figure 17:
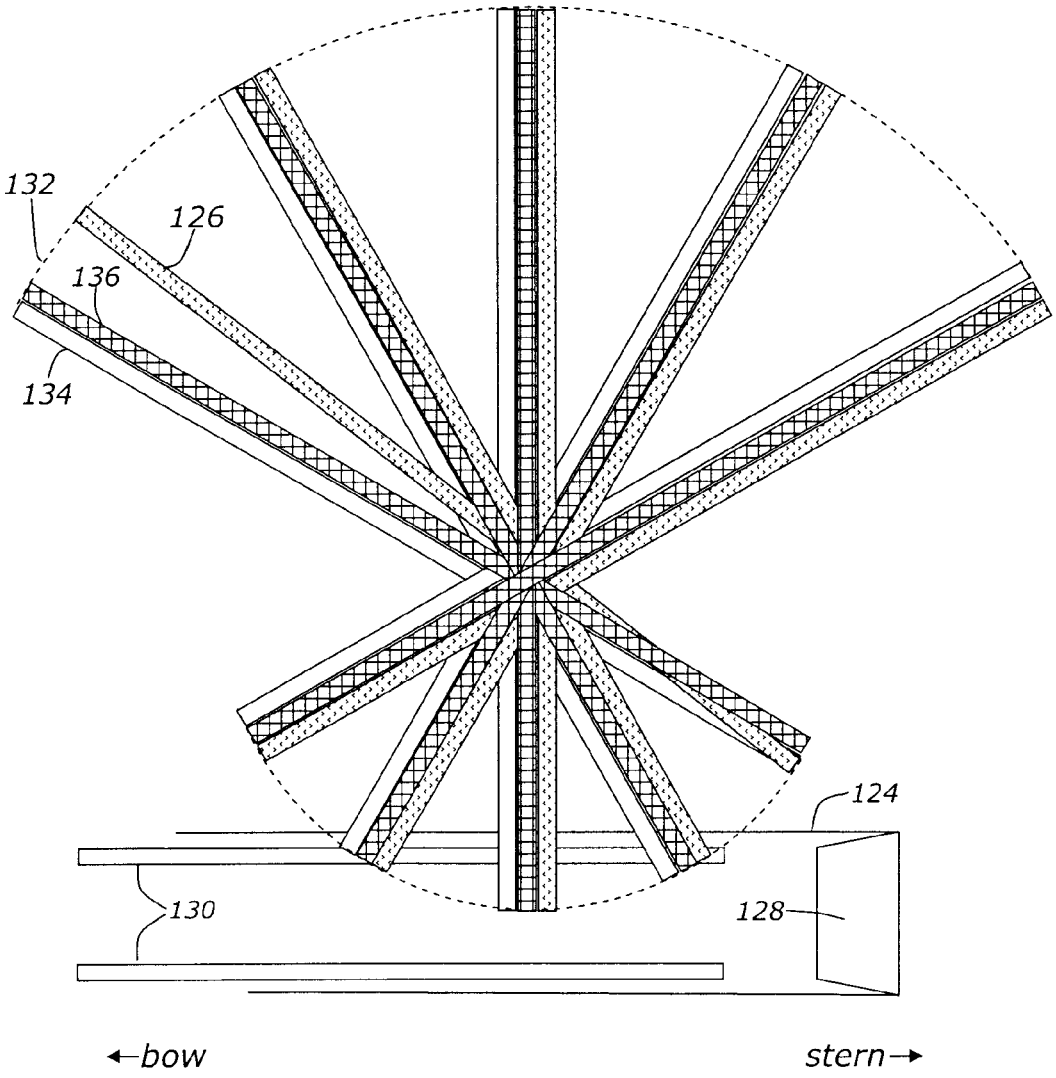
FIG. 17 is a perspective view of the rowlock of FIG. 16 in a negative fulcrum.

The frame 96 is mounted on the rigger 114 having struts 116, 118, 120 and 122 which are attached to the rowing shell 124 shown in FIG. 17.

FIG. 15 shows the rowlock 10 in a 'positive' fulcrum wherein the oar 126 may be inserted into the rowlock 10 behind the horizontal axis of rotation of the oar 126 with respect to the bow of the shell 124 shown in FIG. 17. A rower (who is not shown) places his or her feet on the platform 128 and moves on a seat (which is also not shown) which rides on slides 130 so that the oar 126 inscribes an arc 132 in the horizontal plane during a stroke.

Figure 16:
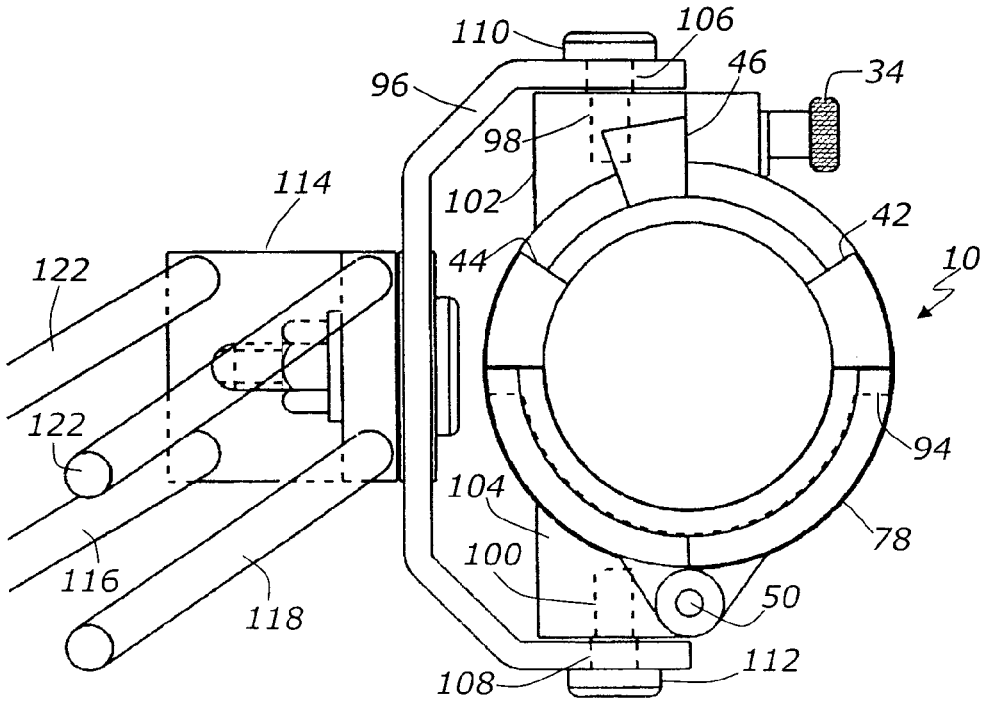
FIG. 16 is a perspective view of a fully assembled rowlock according to a second embodiment of the present invention in a positive fulcrum.

The rowlock 10 is shown in a 'negative' fulcrum in FIG. 16 (in which like parts are given like numbers to previous figures), wherein the oar 134 is in front of the horizontal axis of rotation with respect to the bow of the shell 124 (see FIG. 17).

Figure 18:
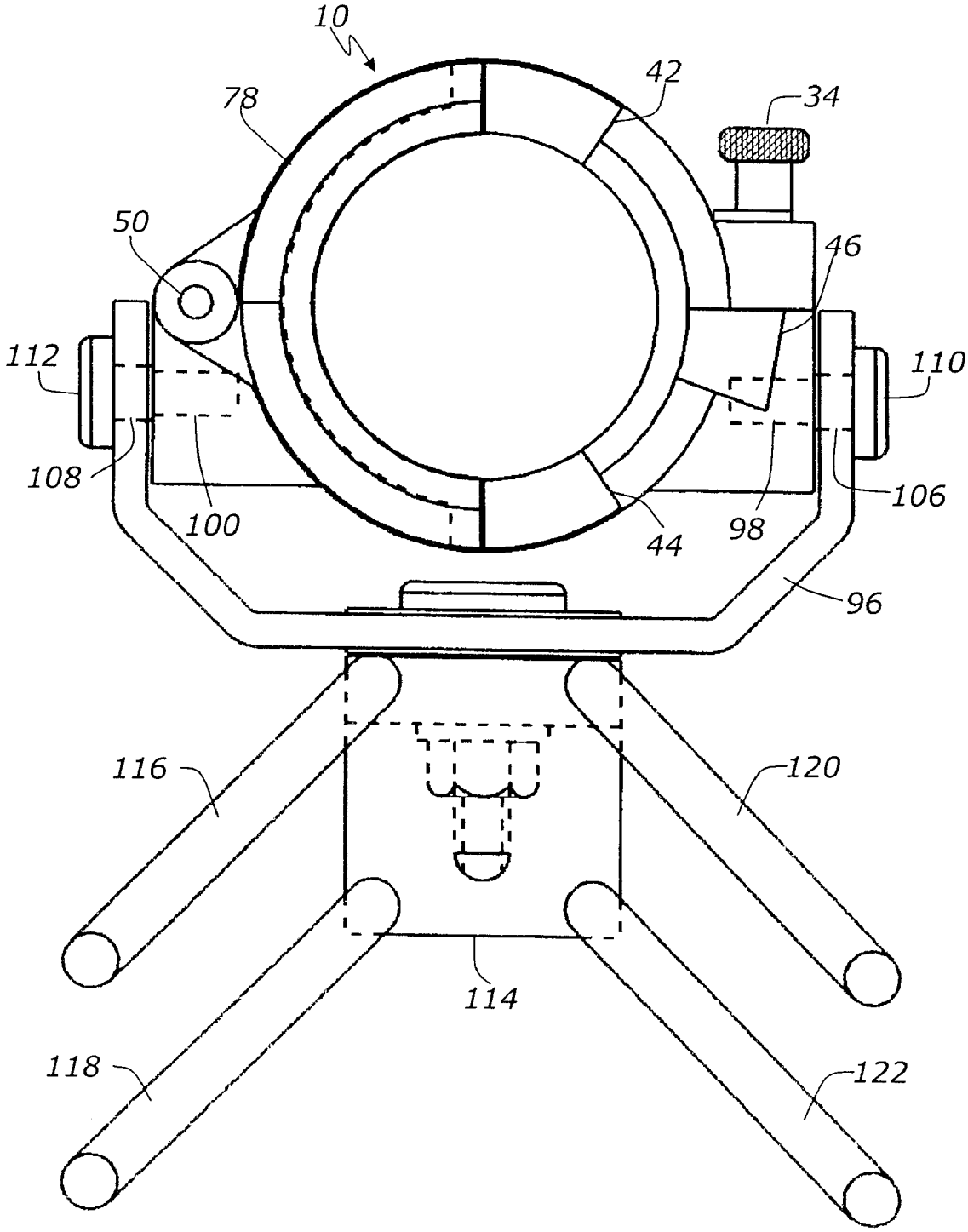
FIG. 18 is a perspective view of the rowlock of FIG. 16 in a neutral fulcrum.

The rowlock 10 is shown in a 'neutral' fulcrum in FIG. 18 (in which like parts are given like numbers to previous figures), wherein the oar 136 is above the horizontal axis of rotation with respect to the bow of the shell 124 (see FIG. 17).

Various modifications may be made in the details of design and construction without departing from the scope and ambit of the invention.

The invention claimed is:

1. An adjustable rowlock for changing the orientation of the blade of an oar, the rowlock comprising:

a body having a clamp and clamp adjusting means, the clamp including upper and lower sections which are pivotally connected at a first end and releasably connected at a second end;

a rotating bracket positioned within the upper and lower sections of the clamp;

an oar sleeve having a datum mark to be aligned with a plurality of reference marks arranged on the body so that a user may choose from a plurality of orientations of the blade corresponding to the reference marks, to suit the water conditions; and a clip which is affixed to the rotating bracket and rotates adjacent to the clamp.

2. The rowlock of claim 1 wherein the rotating bracket has the reference marks arranged thereon.

3. The rowlock of claim 1 wherein the rotating bracket has one or more datum surfaces whose orientation relative to the clamp is adjustable using the clamp adjusting means.

4. The rowlock of claim 3 wherein the range of motion of the or each datum surface on the rotating bracket is restricted by one or more locking stops on the body of the rowlock.

5. The rowlock of claim 1 wherein the rotating bracket has ridges to secure the lateral position of the rotating bracket within the upper and lower sections of the clamp.

6. The rowlock of claim 1 wherein a bush is placed between the rotating bracket and the clamp to reduce friction when feathering the oar.

7. The rowlock of claim 1 wherein the body includes a spindle which is adapted to permit a vertical range of movement of the oar.

8. The rowlock of claim 7 wherein the body includes a rowlock pin housing adapted to connect to the spindle.

9. The rowlock of claim 8 wherein the rowlock pin housing is adapted to permit a horizontal range of movement of the oar.

* * * * *

UNITED STATES PATENT AND TRADEMARK OFFICE

CERTIFICATE OF CORRECTION

PATENT NO. : 8,002,598 B2
APPLICATION NO. : 12/363508
DATED : August 23, 2011
INVENTOR(S) : Paul John Ninham and Lindsay Gamble It is certified that error appears in the above-identified patent and that said Letters Patent is hereby corrected as shown below:

| Col. No. | Line(s) | Edits |
|---|---|---|
| Title Page | Item (30) | Please add "**(30) Foreign Application Priority Data** August 7, 2008.....2008 904 035" |

Signed and Sealed this
Twentieth Day of March, 2012

David J. Kappos

David J. Kappos
*Director of the United States Patent and Trademark Office*